US005176294A

United States Patent [19]

Della Riva

[11] Patent Number: 5,176,294

[45] Date of Patent: Jan. 5, 1993

[54] PACKAGING FOR LIQUID OR PULVERULENT PRODUCTS

[75] Inventor: Carlo Della Riva, Brussels, Belgium

[73] Assignee: S.A. Incoplas N.V., Brussels, Belgium

[21] Appl. No.: 645,265

[22] Filed: Jan. 24, 1991

[30] Foreign Application Priority Data

Jan. 26, 1990 [BE] Belgium ..... 9000101

[51] Int. Cl.[5] ..... B67D 5/06

[52] U.S. Cl. ..... 222/105; 222/183; 222/539; 222/545

[58] Field of Search ..... 222/105, 183, 107, 215, 222/522, 525, 539, 545

[56] References Cited

U.S. PATENT DOCUMENTS

| | | | |
|---|---|---|---|
| 2,799,427 | 7/1957 | Shekter | 220/20 |
| 3,042,271 | 7/1962 | Winstead | 222/183 |
| 3,226,002 | 12/1965 | Walker | 222/183 |
| 3,252,634 | 5/1966 | Scholle | 222/105 |
| 3,253,764 | 5/1966 | Goetschius et al. | 229/17 |
| 3,977,569 | 8/1976 | Scholle | 222/105 |
| 4,174,051 | 11/1979 | Edwards et al. | 222/105 |

FOREIGN PATENT DOCUMENTS

| | | | |
|---|---|---|---|
| 0264606 | 4/1988 | European Pat. Off. . | |
| 2157769 | 5/1973 | Fed. Rep. of Germany | 222/215 |
| 8904656 | 8/1989 | Fed. Rep. of Germany . | |
| 1194634 | 11/1959 | France . | |
| 2395913 | 1/1979 | France . | |
| 6812152 | 3/1970 | Netherlands . | |
| 0244973 | 10/1969 | U.S.S.R. . | |
| 2088837 | 6/1982 | United Kingdom | 222/105 |

*Primary Examiner*—H. Grant Skaggs
*Attorney, Agent, or Firm*—Leonard Bloom

[57] ABSTRACT

The packaging of the invention consists in an assembly composed of a cardboard box and of a bottle made from plastic material contained in this box. It is equipped with flexible shoulders enabling the spout to be retracted inside the box or brought outside the latter, the neck of the bottle then being engaged in an opening provided in the cover of the box.

17 Claims, 2 Drawing Sheets

VII
VII

PACKAGING FOR LIQUID OR PULVERULENT PRODUCTS

FIELD OF THE INVENTION

The present invention relates to a packaging for liquid or pulverulent products which is particularly suitable for food products and chemicals.

BACKGROUND OF THE INVENTION

The packing and transportation of products which can flow (particularly liquid products) have long posed an awkward problem.

Although pulverulent products can be transported in other ways, the invention provides an advantageous alternative.

Metal containers and glass containers are markedly less commonly used than in the past: they are generally heavy, permitting little variation in form, and are relatively expensive. Glass containers are, moreover, breakable, which is a major disadvantage. As for metal containers, these are easily deformed irreversibly if they are dropped.

Consequently, for a few decades now, the use of various containers made from plastic material has become commonplace for packing, inter alia, liquid food products, or for use in industry or in every day life.

All kinds of containers which were formerly made from glass or metal have therefore gradually been replaced by containers made from plastic material which are intended for the same types of use. These new containers permit easier handling and treatment, particularly by virtue of the reduction in risks of breakage or harmful deformations.

A number of problems specific to the use of plastic materials for packaging liquid products have appeared over time, some of which still exist today, which the present invention attempts to remedy.

For reasons of economy, it is desirable for containers made from plastic material to be as light as possible.

With this in mind, and on the basis of forms copied from glass or metal packaging, packaging in plastic material has gradually evolved towards forms which are better adapted to the characteristics of the material, these forms making it possible to optimize resistance to vertical compression, the limit being given by a non-visible and non-permanent deformation of the packaging.

Most of the forms developed which have both good resistance to vertical compression and a light weight nevertheless have a major drawback: the ratio between the volume occupied by the spatial requirement of the packaging and the volume of the liquid product packed is high and in all cases never reaches the optimum value of 1:1 In tear drop-shaped bottles, for example, this ratio is generally greater than 2:1. The loss of volume is thus huge and considerably increases packaging, handling, storage and distribution costs.

Due to their rigidity, most containers made from plastic material also take up considerable space in the volume of domestic or industrial waste. It can easily be understood that it is desirable for this volume to be minimized.

Extremely light packaging made from plastic material which, after use, occupies a particularly small volume has been on the market for a long time. This packaging is namely, envelopes or the like made from flexible plastic material, also referred to as sachets, which are provided for packing shampoos, conditioners or food products such as milk. This type of packaging is, however, rarely used, since it is extremely impracticable. Once opened, the envelopes cannot in fact be closed again or kept upright. It is thus necessary to use their contents in one go. Moreover, as there is a thin film without external protection, the risks of leakage are considerable.

Plasticized cardboard boxes of the brick type for milk make it possible to save space during transportation and storage. They comprise a small quantity of plastic material and, after use, occupy a small volume in refuse, provided that care is taken to flatten them.

These boxes are manufactured from a cardboard sheet. At least one layer of polyethylene and, optionally, a layer of another material such as aluminium are made integral with the cardboard sheet by being stuck together or by other means. This results in a particularly troublesome drawback from the ecological stand- point: the materials which form the single composite layer of the packaging cannot be dissociated from one another and thus cannot be separated by simple means. Thus, they can neither be destroyed selectively by incineration nor be recovered for the purposes of recycling. Also, since the actual cardboard has been plasticised, it is rendered rot proof.

The method of opening boxes of the brick type for milk is as follows: the user must lift a part, which is folded on the top of the box and folded over the sides, and cut off its corner. If the cutting operation is not performed correctly, which often occurs, milk is spilt when the user picks up the brick in order to pour out its contents. No provision is made, after opening, for the possibility of reclosing this type of packaging.

For packing liquid washing agents, packaging formed from a combination of cardboard and sheets of plastic materials which can, in certain cases, be reclosed each time the product is used, has recently been developed.

Particularly, packaging of the brick type for milk described above, whose method of opening is different, has been marketed: a pouring spout, consisting of an injection-moulded component made from polyethylene, is glued to the centre of the upper wall of the box. When using the container for the first time, the consumer must himself pierce a hole in the wall of the packaging, through the spout, thus creating lips which face the inside of the box and which prevent total emptying of the box. As the spout is applied to the outer part of the composite film forming the wall of the packaging, it can become detached in the event of impact or rough treatment. As with bricks for milk, any recycling of plastic material or of cardboard is impossible.

Moreover, stacking and palletization are difficult due to the projecting pouring spout.

Another type of packaging known on the market and provided for liquid washing agents permits easier pouring of the product. This is packaging which consists of a cardboard sheet which has been given the form of a box, in which a sheet of plastic material welded into the form of a bag, is glued at several points. The upper wall of this packaging is manufactured with an off-centre hole. A spout which is integral with the cardboard and with the sheet of plastic material is positioned at the location of the hole provided on the top of the box. Opening, closing and pouring of the product are relatively easy. Nevertheless, it is observed that, in practice, due in particular to the parallelepipedal form of the box, it is also virtually impossible to empty.

Once again, the components (cardboard and plastic material) are very difficult to dissociate from one another, which is undesirable from an ecological standpoint. Moreover, this type of packaging requires the use of a considerable amount of adhesive. Finally, the problems of stacking and palletization are still not solved.

There is a particular model of this type of packaging which has a large opening provided in the cover. The spout, which is then integral only with the sheet of plastic material, is able to retract into the box via this opening. What frequently happens now is that it moves obliquely and disappears inside the box, from where it is then awkward to recover. The direction of the flow of product is not guaranteed either, on pouring.

There is also another particular model of this type of packaging, in which the spout is located in a "cut corner" of the cardboard box. In this case, the resistance of the packaging to vertical compression is diminished.

The packaging mentioned above are not designed in order to be filled via the spout. They must be manufactured and filled by complicated and expensive machines which make the cardboard, apply the plastic material thereto and proceed immediately to filling. In each case, this means that the manufacturer of the packaged product must transport his merchandise in bulk to the premises where the packaging is manufactured or invest in machines for manufacturing and filling the packaging, which involves additional cost.

SUMMARY OF THE INVENTION

The invention aims to provide packaging for liquid or pulverulent products, composed of cardboard and an amount of plastic material which is small compared with the content of the packaging, which permits total separation of its constituent materials, which can be sorted before being discarded, and which permits selective collection and recycling of the constituent materials.

An object of the invention is to provide a packaging for liquid or pulverulent products which occupies as small a volume as possible after the product has been used.

A major object of the invention is to provide packaging which, although composed of two elements, has a total weight which is no greater than that of a traditional bottle.

The invention also aims to provide packaging for liquid or pulverulent products which can easily be stacked and palletized and which has a configuration such that the ratio of the volume occupied by the spatial requirement of the packaging to the volume of the packed product is very close to the value 1, and for this to be so while retaining the characteristics of good resistance to vertical compression exhibited by conventional bottles made from plastic materials.

A further object of the invention is to provide packaging for a liquid product, composed of cardboard and of plastic material, which can be manufactured on traditional machines and filled on traditional filling lines used for filling bottles.

The invention further aims to provide packaging for liquid or pulverulent products which makes it possible to easily pour the product contained therein, while preventing any spilling of the latter, which packaging can be opened and reclosed easily after use and which, above all, makes it possible to use all the product, so as to avoid any wastage and any mixing of product residue with other domestic or industrial refuse.

A final object of the invention is to provide packaging for liquid or pulverulent products in which the risk of leakage is reduced.

The subject of the invention is packaging for liquid or pulverulent products, which consists of an assembly composed of a cardboard box and of a bottle made from plastic material that is contained in this box without being attached thereto, that is to say without being glued or welded thereto. In this fashion, the bottle can be separated from the box very easily and without any tearing after this box has been opened. The box in question comprises lateral walls and a cover. An opening is provided in the cover. The bottle comprises a base, a body, shoulders, a neck and a spout on which a stopper is fitted. The body of the bottle has sufficient flexibility to be able to substantially match the lateral walls of the box; its shoulders have sufficient flexibility for a pressure exerted downwards on the spout to deform them so as to retract the said spout inside the box. The flexibility of the shoulders also makes it possible for traction (force) to be exerted on the spout to bring (pull) the spout outside the box, the bottle then occupying a position in which it can be filled via the spout. The stopper can be positioned on or removed from the spout as desired and the contents of the bottle can be poured out via the spout.

The packaging of the invention can thus assume a "box position" in which the spout is retracted and a "bottle position" in which it is, on the other hand, projecting.

The cardboard box may optionally be devoid of a base (on the side opposite to the cover in which an opening is provided).

However, this box may be provided with a base.

This base may optionally be incomplete and formed, for example, from edges of the lateral walls folded inwards at the lower part of the box, the width of these edges being such that there is still an opening in the centre of this box base.

According to a particular embodiment, the spout of the bottle is threaded and the stopper is threaded in a corresponding manner to engage one another. In this manner, the stopper can be selectively positioned on and removed from the spout, so that the contents may be selectively retained therein or removed therefrom.

However, this type of closure of the spout is not critical in any way and many other stoppering systems can be used such as, for example, "bayonet" stoppering systems.

According to a preferred embodiment of the packaging of the invention, the neck of the bottle is equipped, at least over a part of its height, with support means which can interact with the cover of the box in order to hold the spout outside this box when the neck is engaged in the opening. These means can consist in a collar which rises above the lower part of the neck.

Advantageously, the neck of the bottle can also be equipped, in its lower part, with locking means which interact with the cover in order to lock the neck (and thus the entire bottle) to prevent rotation thereof when the said neck is engaged in the opening of the cover. The lower part of the neck and the edges of the opening may be notched. They may also have a form which is not circular, for example an oval, elipitical or polygonal form. Successful use will be made of hexagonal, octagonal, square or even triangular forms.

When the spout is retracted inside the box, it is advantageous for the stopper not to penetrate fully therein.

To this end, the stopper will advantageously be equipped with a stop member which can consist simply of a shoulder located near to the top of the spout.

According to a preferred embodiment, the opening provided in the cover of the box has dimensions such that, when the spout is retracted inside the box, the edge of the opening laterally surrounds the stopper and thus prevents the involuntary emergence of the spout, equipped with its stopper, outside the box, for example following impacts which could occur during handling or transportation.

According to an alternative embodiment, the stopper is equipped with a retention member which, when the spout is retracted inside the box, interacts with the bottom of the cover and prevents the involuntary emergence of this spout, equipped with its stopper, outside the box. This member can consist of lugs or, alternatively, a flange.

When the spout is retracted inside the box and it is desired to remove it therefrom, for example in order to pour the product, the operation will be facilitated by the presence, on the stopper, of at least one handle intended to promote pulling of the spout outside the box.

The body of the bottle of the packaging according to the present invention is preferably equipped, over at least a part of its height and at least part of its periphery, with stiffening means, for example grooves and ribs which can be arranged either in an axial direction or in a radial direction, or in a combination of the two.

The bottle can have a substantially circular form or, alternatively, a rectangular form with rounded corners or any other desired form. As for the box, it may be cylindrical or prismatic.

A particularly advantageous material for manufacturing the bottle is polyethylene, but it is also possible to use polyethylene terephthalate (PET), polypropylene or other plastic materials which can be recycled or incinerated without releasing harmful gases. The use of polyethylene is advantageous for more than one reason, since it is particularly suitable for recycling.

The bottle of the packaging of the invention will not generally be self-supporting.

The packaging of the invention is no heavier than a traditional bottle of equal capacity and makes it possible to use up to three times less plastic material.

When pouring the product, it flows continuously without causing air bubbles to rise in the bottle, and which makes it possible to direct the flow very accurately.

Because the external presentation of the packaging of the invention is provided by the cardboard box, for manufacturing the lightweight bottle, it is possible to use waste plastic material originating from the manufacturing process for conventional packagings. It is thus possible to manufacture a single-layer bottle entirely from recovered plastic material. Its light weight, its consistency and its functionality will be identical to those of a bottle manufactured from fresh material. Only its appearance will be modified, for example if the recovered plastic material originates from silk-screen printing waste, which involves a modification of the colour of the bottle.

Moreover, the coexclusion technique today makes it possible to produce multi-layer bottles, with the aim of recycling the plastic material contaminated by the products and originating from the consumer's dustbin. For this recycling to take place, it is essential to prevent the material which has been contaminated, and no longer offers the guarantees of cleanliness currently required for all packaging, to be separated from the contents by a layer of fresh plastic material intended to prevent contact between the recycled and contaminated material and the contents of the packaging.

The colour of the recycled material, tending towards a wide variety of greys, requires traditional bottles also to have an external layer of plastic material, referred to as the presentation layer, when the colour required for the bottle is incompatible with grey.

A third layer of material, sandwiched between the first two layers, will permit the incorporation of waste originating from the manufacture of the actual packaging (waste which can represent 50% of the net weight of a bottle with a handle, for example) and the use of genuinely recycled material, that is to say contaminated and originating from refuse ("post-consumer" recycling).

The invention makes it possible to increase the proportion of recycled material by doing away with the presentation layer, which is rendered useless given that it is the cardboard which gives the packaging its attractive appearance.

Attempts are currently being made to develop packaging in degradable plastic materials. One of the problems encountered by such projects is the determination of the lifespan of the material before degradation commences.

In the packaging of the invention, the bottle is protected from the light by the cardboard box until the product has been used. It thus makes it possible to use plastic materials which degrade very rapidly through the action of light, that is to say UV radiation. Degradation of the plastic material commences as soon as the bottle is exposed to the light, that is to say as soon as it is separated from the box either due to human action or due to the natural decomposition of the cardboard.

Other features and advantages of the invention will emerge from the description of particular embodiments which is given below, reference being made to the appended drawings.

BRIEF DESCRIPTION OF THE DRAWINGS

FIG. I is a view, partially in cross-section, of packaging for liquid or pulverulent products according to the invention, in which the spout is in a projecting position ("bottle position").

DESCRIPTION OF PREFERRED EMBODIMENTS

Figures 1, 2, 3, 4:
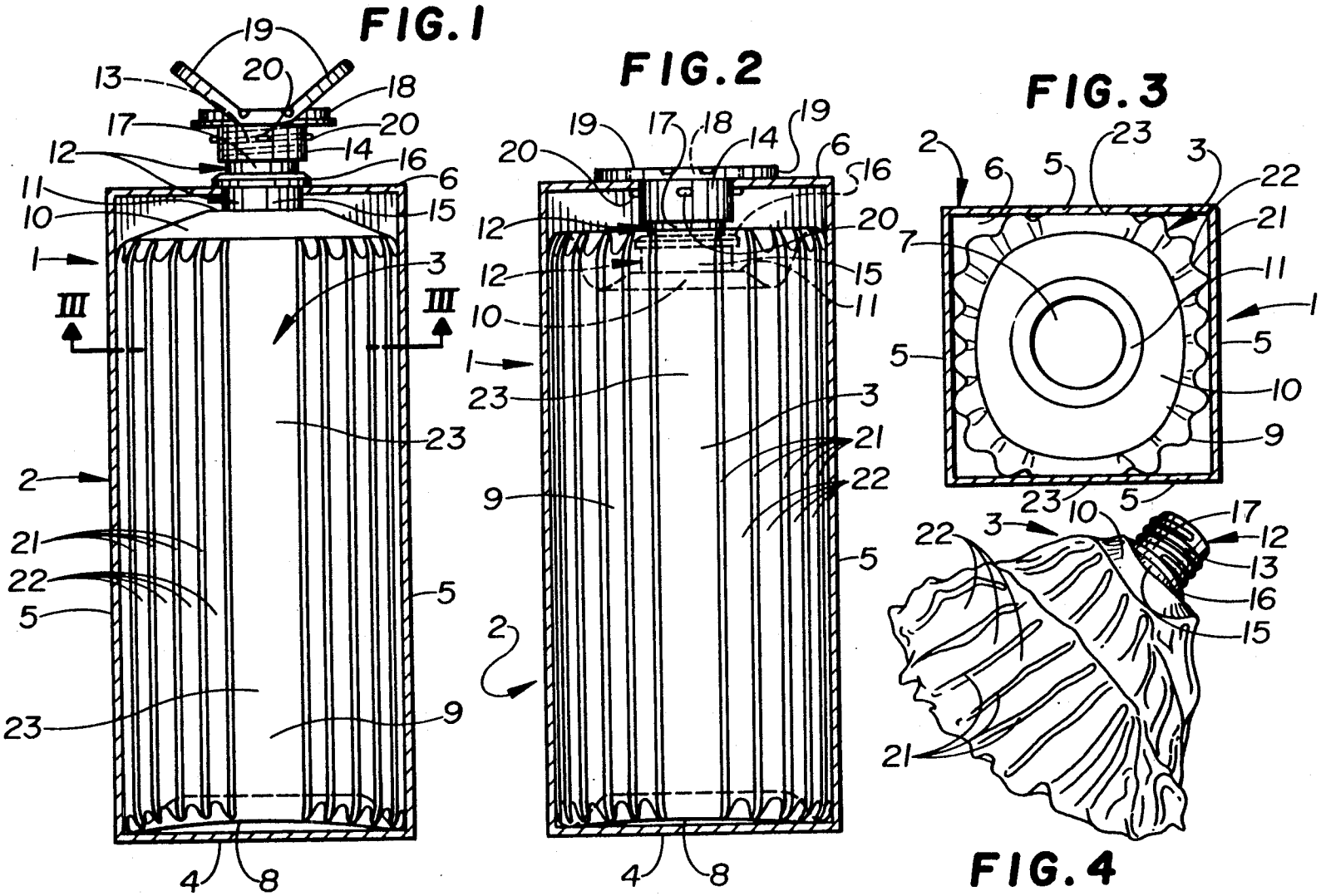
FIG. 2 is another view, partially in cross-section, of the same packaging, in which the spout is in a retracted position ("box position").
FIG. 3 is a section along the line III—III of FIG. 1.
FIG. 4 is a perspective view of a bottle which has been removed, after use, from a packaging according to the invention and has been reduced to a small volume.

FIGS. 1 to 3 show a packaging 1 for liquid or pulverulent products according to the invention.

This packaging 1 consists of a cardboard box (a substantially rigid outer shell) 2 with a square section and a bottle (a substantially flexible inner shell) 3. For ease of presentation, the bottle 3 has been shown in elevation and the box 2 in cross-section in FIGS. 1 and 2.

The box 2 is integral, conventionally comprising a base 4, four lateral walls 5 and a cover 6 opposite of the base 4. A circular opening 7 is formed in the cover.

The bottle 3 is manufactured from polyethylene. This bottle 3 comprises a bottom (a base) 8, a body 9 extending upwardly from the base 8, of substantially circular section. Flexible shoulders 10 extending from the upper end of the body 9, opposite of the base 4, to a surface 11 which forms the limit between the shoulders 10 and the neck 12. The neck 12 extends in terms of height up from the shoulders 10 to the start of the screw thread (shown in broken lines in FIG. 1) of the threaded spout 13, which extends from the neck 12 opposite of the shoulders 10 and on which a threaded stopper 14 is removably screwed.

The body 9 and the shoulders 10 of the bottle 3 are approximately 0.2 mm thick. As may be seen in FIG. 4, when the bottle 3 is empty, it can easily be separated from the box 2, to which it is not attached either by adhesion or by welding or in any other manner. It may then be rolled by hand like a toothpaste tube, which enables it to occupy a very small volume in waste.

This also makes it possible to extract the very last drop of the product. As for the box 2, it can be flattened like any cardboard box.

The neck 12 is divided into three distinct elements (parts) along its height: the lower part 15, the collar 16 and the upper part 17. FIGS. 1 and 2 clearly show that the bottle 3 can occupy two different positions relative to the box 2.

FIG. 1 shows the packaging 1 in its position provided for filling with or pouring out the product. In fact, it can then be treated as a simple bottle and, in particular, be filled on traditional bottle-filling lines.

The collar 16 bears on the cover 6 and therefore holds the flexible shoulders 10 in a stretched position; the lower part 15 of the neck 12 is engaged in the opening 7 of the cover 6. It can be wedged in rotation therein, for example by virtue of a notching (not shown) of the edges of the opening 7 and of the lower part of the neck 12. It is also possible to give the opening 7 and the neck 12 an oval form.

The position of the packaging 1 provided for transportation and storage is shown in FIG. 2. By virtue of the flexibility of the shoulders 10, a pressure exerted vertically downwards on the spout 13 and the stopper 14 makes it possible for the bottle 3 to disappear inside the box 2. The packaging 1 can then be stacked without difficulty, loaded onto pallets and be treated during manipulation and handling like an ordinary box.

The stopper 14 shown in FIGS. 1 and 2 is particularly well suited to the packaging 1. In its upper part, it is equipped with a shoulder (stop member) 18 which bears on the top of the cover 6 when the spout 13 retracts into the box 2 and then acts as a stop member, thereby preventing the stopper 14 from descending entirely inside the box 2. Two handles 19 can be lifted on its upper part so as to facilitate manual pulling of the spout 13 outside the box 2, for example, when it is desired to pour the product out after transportation.

The stopper 14 is equipped with lugs (retention members) 20 which serve to prevent undesired emergence of the spout 13, equipped with its stopper 14, outside the box 2 during transportation, by interacting with the bottom of the cover 6. When the spout 13 is pushed in, the lugs 20 penetrate under the cover 6 by virtue of a temporary deformation of the latter. The opening 7 of the cover 6 has a diameter such that it serves as a guide for the lower part 15 and the upper part 17 of the neck 12, even if the pressure exerted on the stopper 14 is not completely vertical. This characteristic, combined with the existence of the shoulder 18 and handles 19, which can be folded down, ensures that the cover 6 of the box 2 has a virtually plane surface when the packaging is in its "box position" illustrated in FIG. 2.

FIG. 3 shows that the bottle 3 substantially matches the lateral walls 5 of the box 2 when liquid or pulverant is disposed therein. Over a part of its periphery, its body 9 has a corrugated form, defining a stiffening means, thus forming a succession of grooves 21 and ribs 22 disposed in the axial (vertical) direction. Two smooth zones 23 are also provided.

As the walls of the bottle are very thin, particularly when the packaging 1 is filled with a liquid product, the lateral walls 5 of the box 2 can, in the long term, swell, principally in the lower third of the packaging 1 where the greatest pressure is exerted. In order to alleviate this drawback, the body 9 of the bottle 3 has, in the corresponding zone, a slightly smaller section than in the other parts, so as to counteract the appearance of such a swelling. This characteristic is obviously not apparent when the bottle 3 is full.

Figures 5, 6, 7, 8:
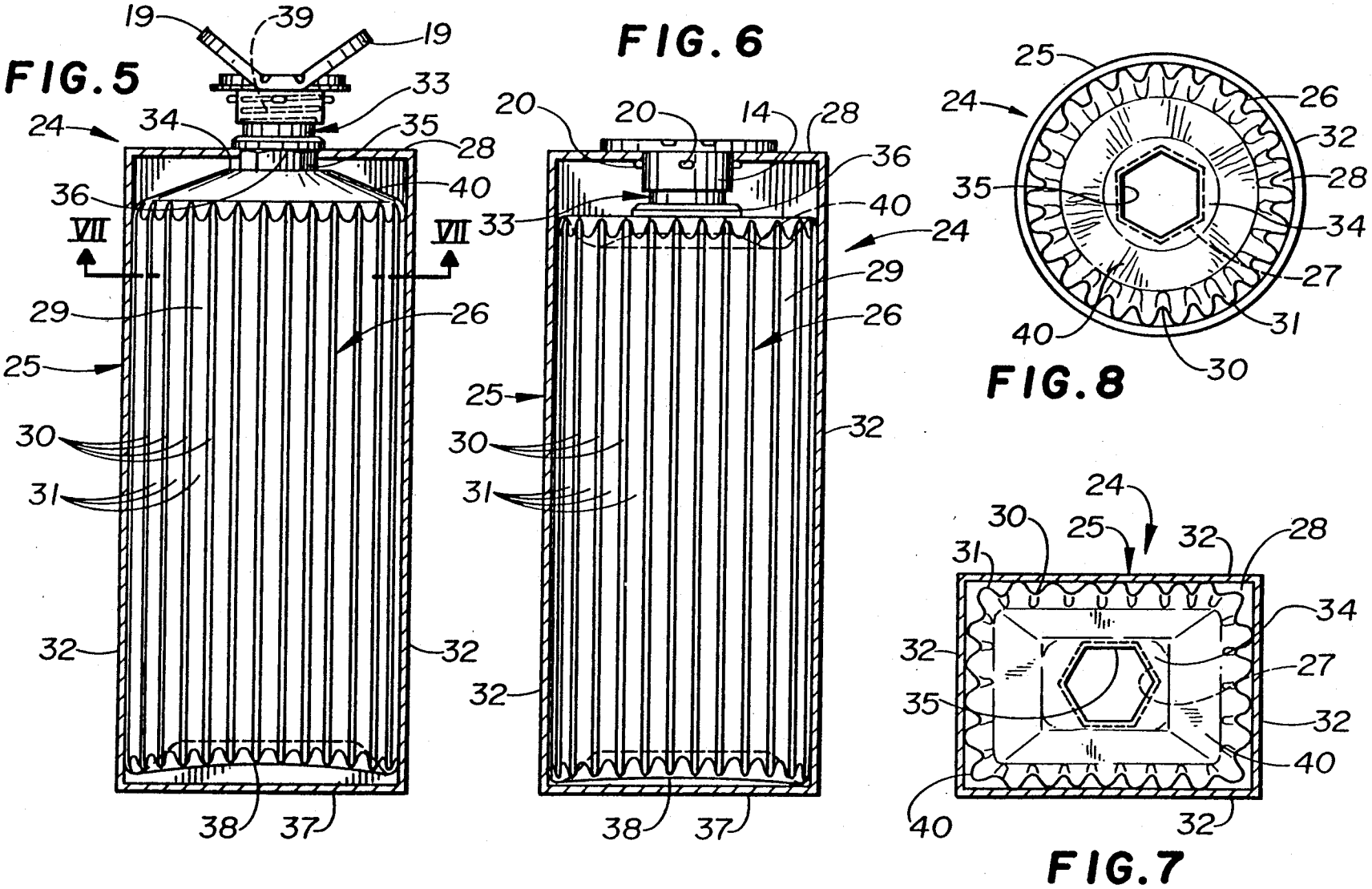
FIG. 5 is a view similar to that in FIG. 1, of another embodiment of packaging according to the invention.
FIG. 6 is a view, similar to that in FIG. 2, of the embodiment shown in FIG. 5.
FIG. 7 is a cross-section along the line VII—VII of FIG. 5.
FIG. 8 is a cross-section view substantially corresponding to FIG. 7, but where the outer shell of the packaging of the present invention has a substantially cylindrical form.

FIGS. 5 to 7 show another embodiment of a packaging 24 according to the invention.

A box 25 of rectangular section contains a bottle 26. The packaging 4 can assume the "bottle position" (FIG. 5) or the "box position" (FIG. 6). An opening 27 of hexagonal form is formed in the cover 28.

The body 29 of the bottle 26 has a substantially rectangular section with rounded corners and is lined over its entire height and over its entire periphery, with grooves 30 and ribs 31. It substantially matches the form of the lateral walls 32 of the box 25. The neck 33 of the bottle 26 rises above a substantially rectangular surface 34 with rounded corners. It has a lower part 35 of hexagonal form which interacts with the edges of the opening 27 when the packaging is in the "bottle position", such that the bottle 26 is wedged in rotation in the box 25. The wedging in rotation is aimed mainly, during screwing of the stopper 14, at preventing twisting of the body of the bottle in the case of bottles having a non-circular section.

In this "bottle position", the bottle 26 is also wedged in respect of height by virtue of the collar 36 which bears on the cover 28. It will be noticed that, in FIG. 5, the height of the box 25 (from its bottom 37 to its cover 28) is slightly greater than that between the base 38 of the bottle 26 and the collar 36 of the latter. When the spout 39 is pushed into the box 25 through the action of pressure exerted vertically downwards on the stopper 14, this results in the bottle 26 descending slightly until its base 38 touches the base 37 of the box 25 with, as a result, a smaller deformation of the shoulders 40 of the bottle 26.

In comparison with the embodiment described with reference to FIGS. 1 to 3, the advantage of this alternative embodiment is that, for an equal product capacity, it makes it possible to manufacture a bottle 26 which has a smaller volume and thus to reduce the amount of plastic material used. Obviously, the strength of the cardboard forming the cover 28 is sufficient to support the weight of the filled bottle 26 without deforming, and in such a way that there is no risk of the collar 36 descending into the box 25 in the absence of another pressure exerted downwards on the spout 39.

Several alternative embodiments may be provided of the packaging described above without thereby departing from the scope of the invention.

In this way, substantially cylindrical bottles may be adapted equally to boxes of square, hexagonal or octagonal section, for example, and to cylindrical boxes themselves (see FIG. 8).

It is possible to manufacture bottles whose body is lined with horizontal (radial) grooves or with a combination of horizontal and vertical grooves, or, alternatively, bottles which are stiffened by virtue of embossed diamond-shaped motifs, or even smooth bottles.

The forms of the neck of the bottle and of the opening provided in the cover of the box may be chosen according to requirements and regardless of the form chosen for the box and the bottle of the packaging.

In an advantageous embodiment not shown in the drawings, the opening of the cover of the box may have a polygonal form, for example hexagonal. The lower part of the neck of the bottle has a corresponding form. There is no collar, but rising above the lower part is a smooth zone corresponding to the thickness of the cover, this smooth zone itself having rising above it an upper part of the neck having the same polygonal form and the same dimensions as the lower part, but offset angularly relative to the latter such that, when the lower part is engaged in the opening of the cover, the bottom of the upper part bears on the cover, thus ensuring locking in respect of height. This embodiment has the advantage of retaining the edges of the opening perfectly intact.

What is claimed is:

1. Packaging for liquid or pulverulent products, comprised of:

a substantially rigid outer shell, the outer shell including lateral walls and a cover, the cover having an opening formed therein;

a substantially flexible inner shell disposed in the outer shell for removably receiving the liquid or pulverulent product therein, the inner shell including a base, a body extending upwardly from the base, shoulders extending from the body opposite of the base, a neck extending from the shoulders opposite of the body and a spout extending from the neck opposite of the shoulders;

the body of the inner shell being sufficiently flexible so as to substantially assume the shape of the lateral walls of the outer shell when liquid or pulverulent product is disposed therein;

the shoulders of the inner shell being sufficiently flexible so that pressure exerted downwards on the spout deforms the shoulders so that the spout retracts inside the outer shell and further so that force exerted upwards on the spout deforms the shoulders so that the spout extends out from the outer shell, wherein the inner shell is in a position in which it can be filled or emptied via the spout; and a stopper removably disposed on the spout, so that the stopper can be selectively positioned on and removed from the spout when desired so that the contents of the inner shell may be selectively retained therein or removed therefrom;

wherein the stopper further includes a retention member that interacts with the bottom of the cover when the spout is retracted inside the outer shell, thereby preventing the undesired emergence of the spout equipped with the stopper from the inside of the outer shell.

2. In combination with the packaging of claim 1, the combination further comprised of:

the outer shell further having a base on which the base of the inner shell is disposed, the base being integral with the lateral walls opposite of the user.

3. In combination with the packaging of claim 1, wherein the spout of the inner shell and the stopper are threaded, so as to engage one another.

4. In combination with the packaging of claim 1, the combination further comprised of:

the neck of the inner shell having a height, supporting means formed between the cover of the outer shell and at least a portion of the height of the neck of the inner shell, such that the cover of the outer shell supports the neck of the inner shell with the neck extending from the outer shell when the neck is engaged in the opening of the cover and equipped with the stopper.

5. The combination of claim 4, wherein the neck further includes a lower part and further wherein the supporting means includes a collar disposed above the lower part of the neck.

6. In combination with the packaging of claim 1, wherein the neck further includes a lower part and further comprising locking means formed on the lower part of the neck that interacts with the cover of the outer shell in order to lock the neck in terms of rotation when the neck is engaged in the opening.

7. In combination with the packaging of claim 1, wherein the stopper includes a stop member which bears on the top of the cover when the spout is retracted into the outer shell, thereby preventing the stopper from descending entirely inside the outer shell.

8. The combination of claim 7, wherein the stop member includes a shoulder formed near the top of the stopper.

9. In combination with the packaging of claim 1, wherein the stopper includes at least one handle for facilitating manual gripping of the stopper and pulling of the spout from the interior of the outer shell.

10. In combination with the packaging of claim 1, wherein the opening in the cover of the outer shell is sized such that when the spout is retracted inside the outer shell, the edge of this opening laterally surrounds the stopper, thereby preventing the undesired emergence of the spout equipped with the stopper from the inside of the outer shell.

11. In combination with the packaging of claim 1, the combination further comprised of:

a stiffening means over at least a part of the periphery and at least a part of the height of the inner shell.

12. The combination of claim 11, wherein the stiffening means includes the body of the inner shell having axial grooves and axial ribs formed therein.

13. The combination of claim 11, wherein the stiffening means includes the body of the inner shell having radial grooves and radial ribs formed therein.

14. In combination with the packaging of claim 1, wherein in transverse section, the body of the inner shell has a substantially circular form.

15. In combination with the packaging of claim 1, wherein in transverse section, the body of the inner shell has a substantially rectangular form with rounded corners.

16. In combination with the packaging of claim 1, wherein the outer shell has a substantially cylindrical form.

17. In combination with the packaging of claim 1, wherein the outer shell has a substantially prismatic form.

* * * * *